US009872571B2

(12) United States Patent
Oh

(10) Patent No.: US 9,872,571 B2
(45) Date of Patent: Jan. 23, 2018

(54) BEDHEAD AND COLLAPSIBLE BED FRAME WITH THE BEDHEAD

(71) Applicant: Grantec (Xiamen) Co., Ltd., Xiamen (CN)

(72) Inventor: Suk Kan Oh, Xiamen (CN)

(73) Assignee: GRANTEC (XIAMEN) CO., LTD., Xiamen, Fujian (CN)

( * ) Notice: Subject to any disclaimer, the term of this patent is extended or adjusted under 35 U.S.C. 154(b) by 0 days.

(21) Appl. No.: 15/605,959

(22) Filed: May 26, 2017

(65) Prior Publication Data

US 2017/0258236 A1 Sep. 14, 2017

Related U.S. Application Data

(62) Division of application No. 15/259,035, filed on Sep. 7, 2016, now Pat. No. 9,713,389.

(30) Foreign Application Priority Data

Sep. 11, 2015 (CN) ..... 2015 2 0702236 U
Sep. 11, 2015 (CN) ..... 2015 2 0702315 U
Sep. 11, 2015 (CN) ..... 2015 2 0702316 U
Sep. 11, 2015 (CN) ..... 2015 2 0702403 U

(51) Int. Cl.
*A47C 17/82* (2006.01)
*A47C 19/00* (2006.01)
*A47C 19/02* (2006.01)

(52) U.S. Cl.
CPC ..... *A47C 17/82* (2013.01); *A47C 19/005* (2013.01); *A47C 19/022* (2013.01)

(58) Field of Classification Search
CPC ..... A47C 19/12
USPC ..... 5/2.1, 53.1, 308
See application file for complete search history.

(56) References Cited

U.S. PATENT DOCUMENTS 6,189,594 B1 * 2/2001 Carter ..... A45C 9/00 160/135

* cited by examiner

*Primary Examiner* — Fredrick C Conley
(74) *Attorney, Agent, or Firm* — Leong C. Lei

(57) ABSTRACT

A bedhead and a collapsible bed frame with the bedhead are provided. The bedhead includes at least two unitary frames. Each unitary frame has at least one storage room at a back thereof. After the collapsible bed frame is disassembled, it can be accommodated in the storage room of the bedhead. For transportation, the parts of the bed frame are accommodated in the storage room of the bedhead, and the unitary frames of the bedhead are folded to form a box. The volume of the bed frame and the bedhead after folded is reduced greatly to be transported and stored conveniently.

13 Claims, 16 Drawing Sheets

BEDHEAD AND COLLAPSIBLE BED FRAME WITH THE BEDHEAD

CROSS-REFERENCE TO RELATED APPLICATION

This is a divisional application of co-pending U.S. patent application Ser. No. 15/259,035 filed on Sep. 7, 2016 and owned by the present applicant.

BACKGROUND OF THE INVENTION

1. Field of the Invention

The present invention relates to a bed, and more particularly to a bedhead and a collapsible bed frame with the bedhead.

2. Description of the Prior Art

A bedhead is usually disposed at one side of a bed frame. In general, the bedhead is to lean against the wall when in use. The bedhead can be as a portion of the bed frame. Two sides of the bedhead are connected with two support boards of the bed frame through connecting members. The bedhead can be directly disposed at one side of the bed frame without a backrest. The bedhead can be sold separately.

Existing bedheads are made in the width of 1 m, 1.2 m, 1.5 m, 1.8 m, 2 m and or on. For packing and transportation, because the width of the bedhead cannot be reduced, it is necessary to use a large-sized packing case. This brings difficulties in packing and troubles in transportation. Particularly, for export transportation, the requirements for the size of packing cases are very strict. When the size of packing cases exceeds a standard packing case, the charge for transportation is high. As a result, the transportation cost of the bed frame is very high.

Accordingly, the inventor of the present invention has devoted himself based on his many years of practical experiences to solve these problems.

SUMMARY OF THE INVENTION

The primary object of the present invention is to provide a bedhead and a collapsible bed frame with the bedhead, which can be packed and transported conveniently. According to one aspect of the present invention, a bedhead is provided.

The bedhead comprises at least two unitary frames. Each unitary frame has at least one storage room at a back thereof.

Preferably, the unitary frames comprise a first unitary frame and a second unitary frame which are disposed symmetrically. Adjacent sides of the first unitary frame and the second unitary frame are pivotally connected to each other.

Preferably, outer sides of the first unitary frame and the second unitary frame are provided with at least one buckle portion and at least one locking portion to mate with each other.

Preferably, at least one of the first unitary frame and the second unitary frame is provided with wheels at two sides of a bottom thereof and a handle at a top thereof.

Preferably, bottoms of the first unitary frame and the second unitary frame are each provided with at least one detachable leg.

Preferably, the unitary frames comprise a first unitary frame, a second unitary frame and a third unitary frame which have a same length and are pivotally connected in sequence. When folded, one of the first unitary frame and the third unitary frame is pivotally turned to the front of the second unitary frame, and the other of the first unitary frame and the third unitary frame is pivotally turned to the back of the second unitary frame.

Preferably, an outer side of the first unitary frame is provided with at least one first buckle portion. An outer side of the third unitary frame is provided with at least one second buckle portion. The second unitary frame is provided with a first locking portion and a second locking portion corresponding to the first buckle portion and the second buckle portion. The first buckle portion is mated with the first locking portion to form a first lock. The second buckle portion is mated with the second locking portion to form a second lock.

Preferably, at least one of the first unitary frame, the second unitary frame and the third unitary frame is provided with wheels at two sides of a bottom thereof and a handle at a top thereof.

Preferably, bottoms of at least two of the first unitary frame, the second unitary frame and the third unitary frame are each provided with at least one detachable leg.

Preferably, the unitary frames comprise a first unitary frame, a second unitary frame, a third unitary frame, and a fourth unitary frame which have a same length and are pivotally connected in sequence.

Preferably, pivotal portions of the first unitary frame, the second unitary frame, the third unitary frame, and the fourth unitary frame are disposed at sides of every adjacent two of the unitary frames.

Preferably, pivotal portions of the first unitary frame, the second unitary frame, the third unitary frame, and the fourth unitary frame are disposed at tops of every adjacent two of the unitary frames.

Preferably, an outer side of the first unitary frame is provided with at least one first buckle portion. The second unitary frame is provided with a first locking portion corresponding to the first buckle portion. An outer side of the fourth unitary frame is provided with at least one second buckle portion. The third unitary frame is provided with a second locking portion corresponding to the second buckle portion. One of the second unitary frame and the third unitary frame is provided with a third buckle portion. The other of the second unitary frame and the third unitary frame is provided with a third locking portion corresponding to the third buckle portion. The first buckle portion is mated with the first locking portion to form a first lock. The second buckle portion is mated with the second locking portion to form a second lock. The third buckle portion is mated with the third locking portion to form a third lock.

Preferably, at least one of the first unitary frame, the second unitary frame, the third unitary frame and the fourth unitary frame is provided with wheels at two sides of a bottom thereof and a handle at a top thereof.

Preferably, the bedhead further comprises a packing case. The unitary frames after folded are placed into the packing case.

According to another aspect of the present invention, a collapsible bed frame with the aforesaid bedhead is provided. The collapsible bed frame comprises the bedhead, two outer support frames disposed at two sides of the front of the bedhead, at least one tail frame connected between the two outer support frames opposite the bedhead, and an inner support frame disposed between the two outer support frames. The outer support frames and the tail frame each comprise detachable support slabs connected to each other. The inner support frame comprises a plurality of detachable support rods. After disassembled, the outer support frames, the tail frame and the inner support frame are accommodated in the accommodation room at the back of the bedhead.

Preferably, the collapsible bed frame further comprises a packing case. After the outer support frames, the tail frame and the inner support frame are accommodated in the accommodation rooms at the backs of the unitary frames of the bedhead, the collapsible bed frame is placed into the packing case.

Accordingly, the bedhead and the collapsible bed frame of the present invention comprise at least two detachable unitary frames. The back of at least one of the unitary frames has a storage room to receive the parts of the bed frame after folded. Thus, the bedhead and the collapsible bed frame can be folded for packing and transportation. The other parts of the bed frame can be received and stored in the accommodation room at the back of the unitary frame of the bedhead. The unitary frames can be folded to form a box and the width of the box is one-half, one-third, or one-fourth of the bedhead, such that the size of the bedhead and the bed frame after folded is reduced greatly for packing, transportation and storage. For export transportation, because the volume of the bed frame is reduced greatly, the bedhead and the bed frame can be packed with a standard packing case. The international transportation fee is decreased greatly to lower the cost.

DETAILED DESCRIPTION OF THE PREFERRED EMBODIMENTS

Embodiments of the present invention will now be described, by way of example only, with reference to the accompanying drawings.

The present invention discloses a bedhead and a collapsible bed frame with the bedhead. The bedhead includes at least two unitary frames. The back of each unitary frame has at least one storage room. After the collapsible frame is folded, it can be stored in the storage room at the back of the unitary frame of the bedhead.

Figure 1:
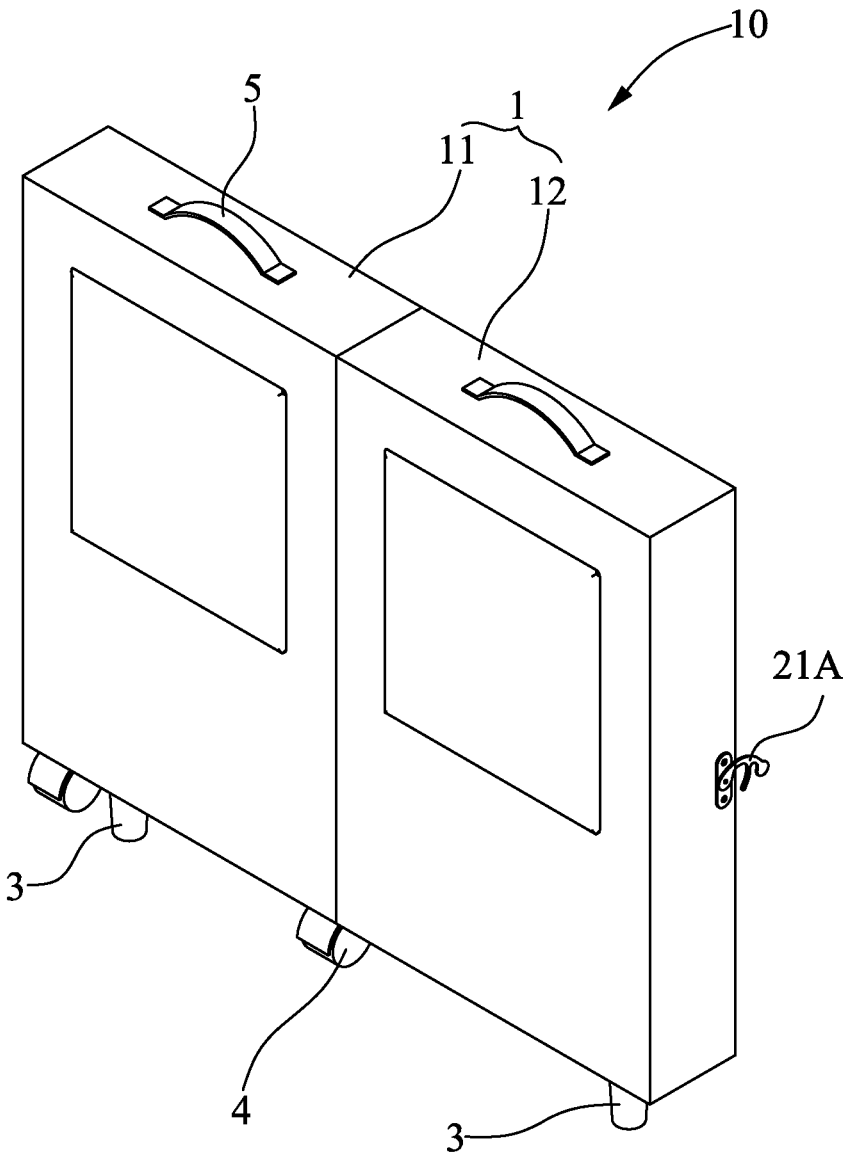
FIG. 1 is a perspective view of the bedhead in accordance with a first embodiment of the present invention.
Figure 2:
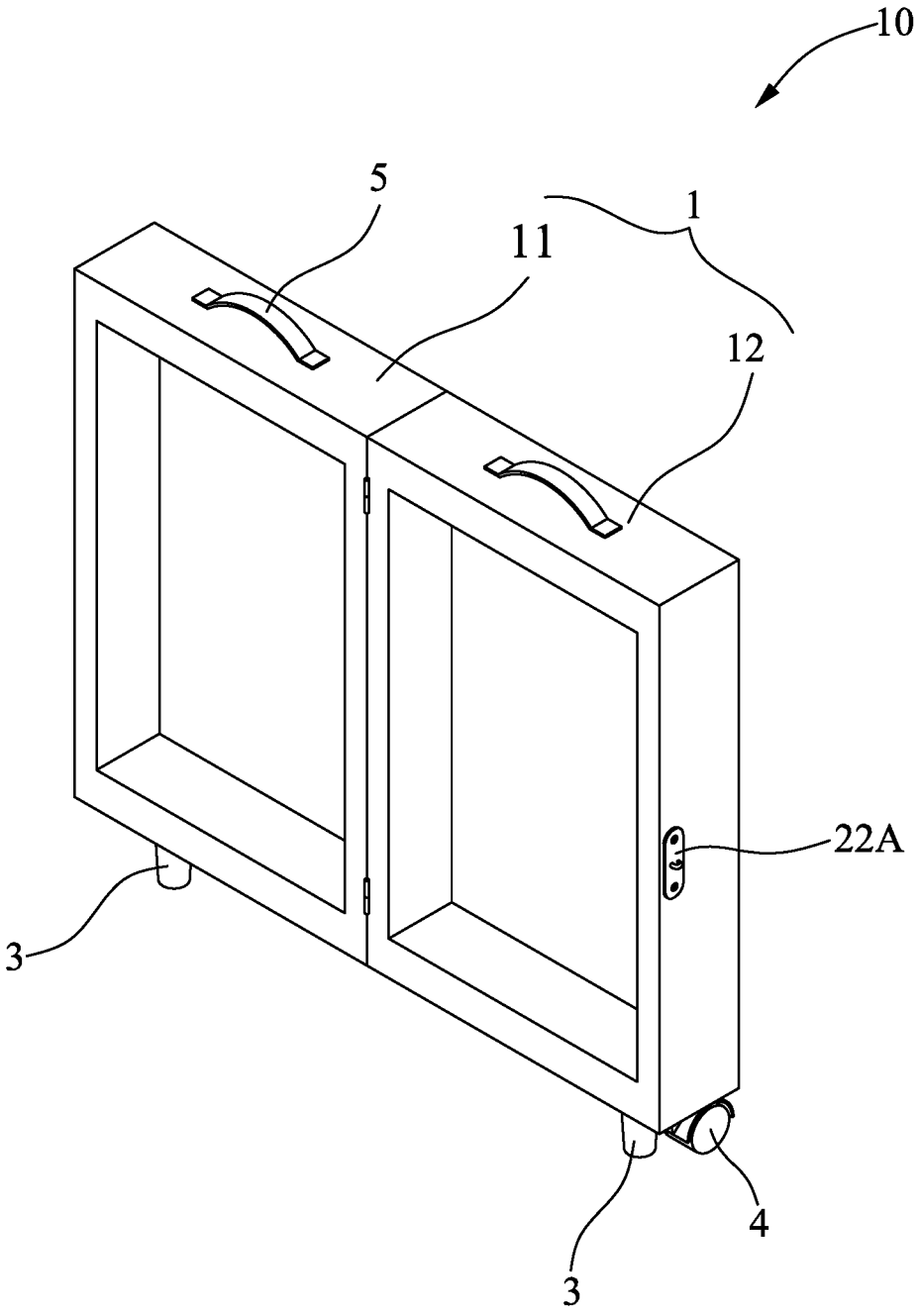
FIG. 2 is a rear perspective view of the bedhead in accordance with the first embodiment of the present invention.
Figure 3:
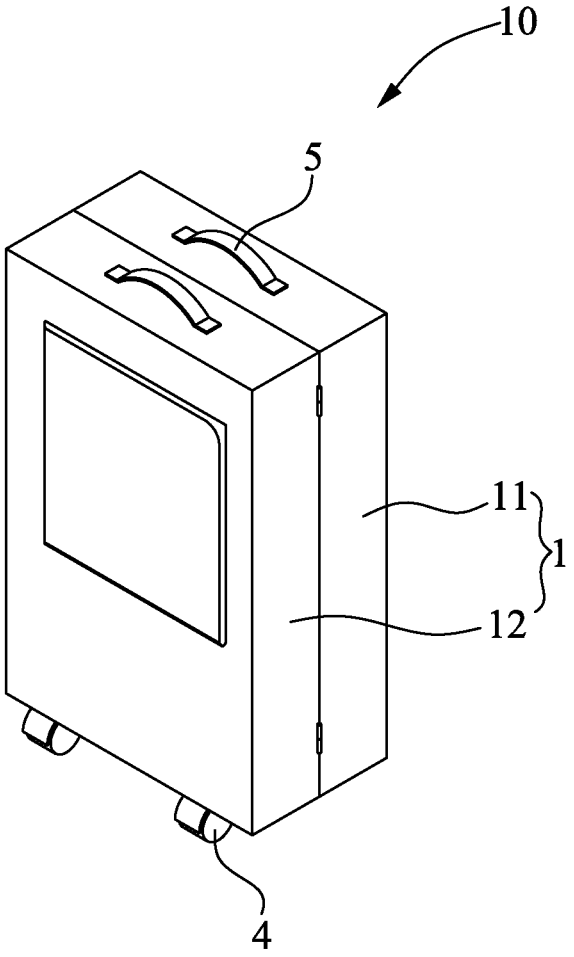
FIG. 3 is a schematic view of the bedhead after folded in accordance with the first embodiment of the present invention.

FIG. 1 to FIG. 3 illustrates a bedhead in accordance with a first embodiment of the present invention. As shown in the drawings, the bedhead 10 of this embodiment includes a first unitary frame 11 and a second unitary frame 12 which are pivotally connected to each other symmetrically. Outer sides of the first unitary frame 11 and the second unitary frame 12 are provided with at least one buckle portion 21A and at least one locking portion 22A to mate with each other. The buckle portion 21A and the locking portion 22A are mated and engaged with each other to fasten the first unitary frame 11 and the second unitary frame 12 when folded. The bottoms of the first unitary frame 11 and the second unitary frame 12 of the bedhead 10 are each provided with at least one detachable leg 3. When the bedhead 10 is used, the legs 3 are mounted to the bottoms of the unitary frames 11, 12. Furthermore, for inconvenient transportation, at least one of the first unitary frame 11 and the second unitary frame 12 of the bedhead 10 is provided with wheels 4 at two sides of the bottom thereof and a handle 5 at a top thereof When the bedhead 10 is carried, the legs 3 are detached from the bedhead 10, enabling the wheels 4 to be on the ground. Through the handle 5, the bedhead 10 can be dragged easily and conveniently like a suitcase.

In this embodiment, the bedhead 10 includes two unitary frames 11, 12 mated with and pivotally connected to each other. For packing and transportation, the two unitary frames 11, 12 are turned and folded, such that the bedhead 10 is folded to form a box and the width of the box is one-half of the bedhead 10. This reduces the size of the bedhead 10 greatly for packing, transportation and storage. For export transportation, because the volume of the bedhead is reduced greatly, the bedhead can be packed with a standard packing case. The international transportation fee is decreased greatly to lower the cost and to enhance the enterprise revenue.

In addition, the buckle portion 21A and the locking portion 22A at the outer sides of the two unitary frames 11, 12 to fasten the two unitary frames 11, 12 when folded. The bottom of the bedhead 10 is provided with the two wheels 4 and the top of the bedhead 10 is provided with the handle 5, so that the bedhead 10 can be dragged easily and conveniently like a suitcase after folded.

Figure 4:
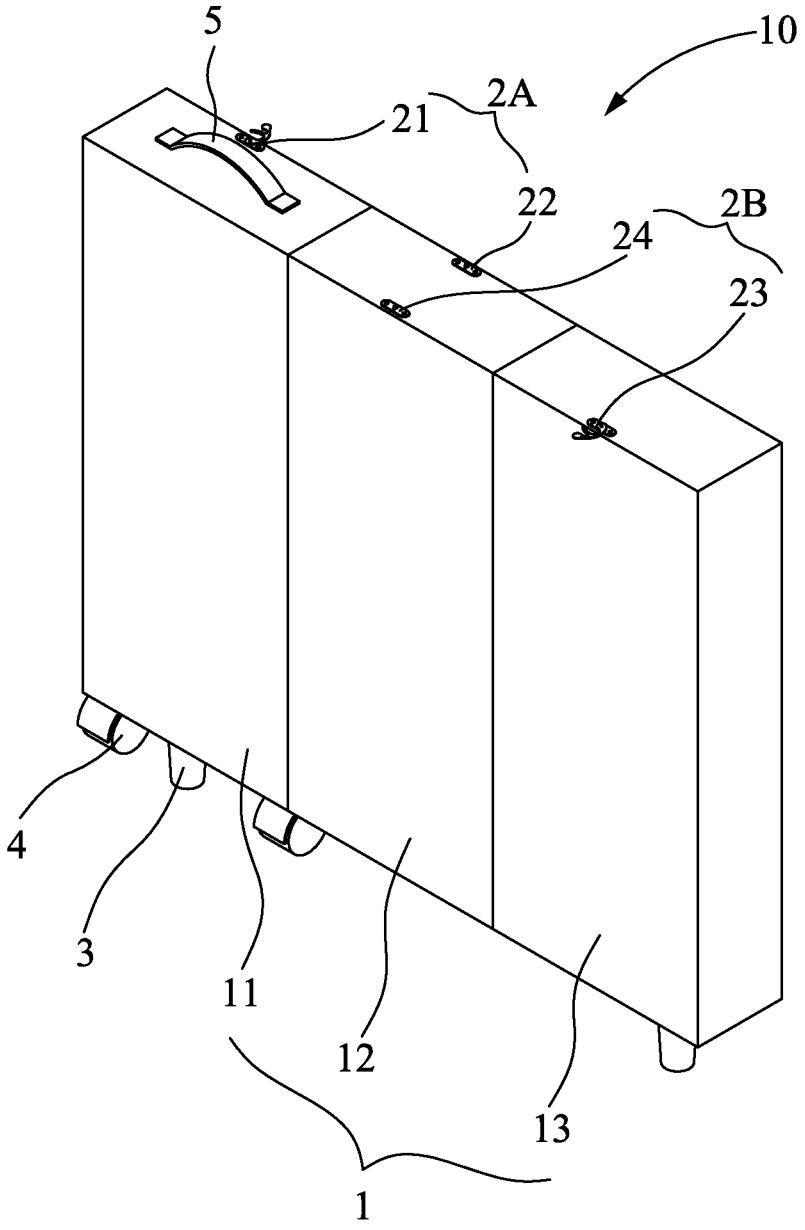
FIG. 4 is a perspective view of the bedhead in accordance with a second embodiment of the present invention.
Figure 5:
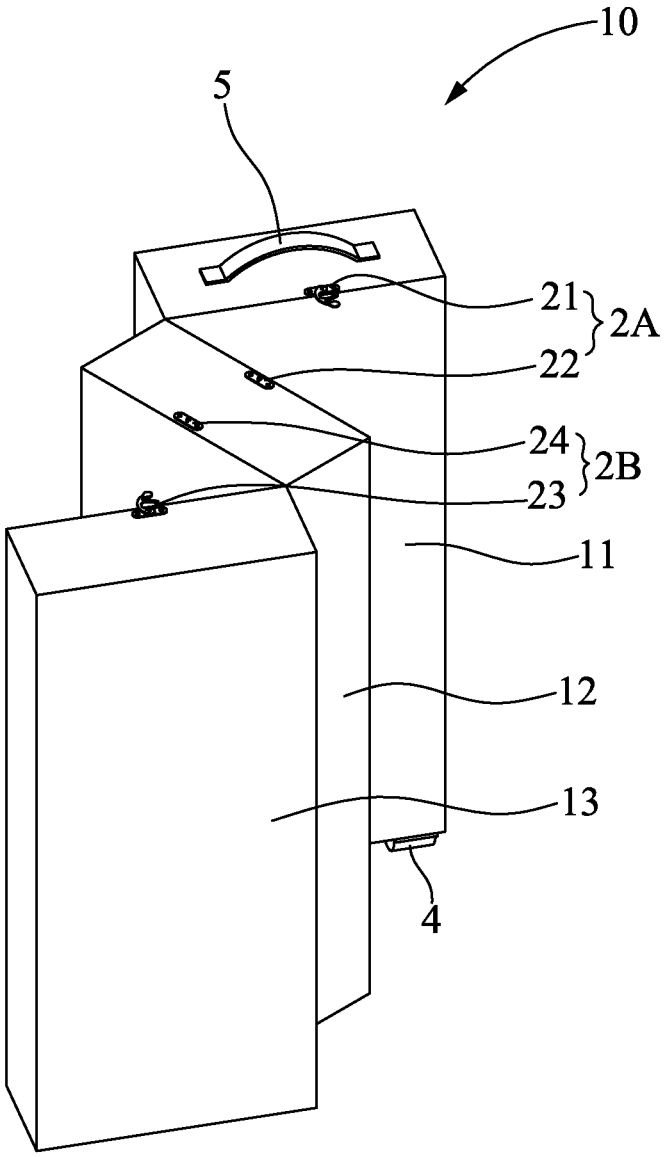
FIG. 5 is a schematic view illustrating the operation of folding the bedhead in accordance with the second embodiment of the present invention.
Figure 6:
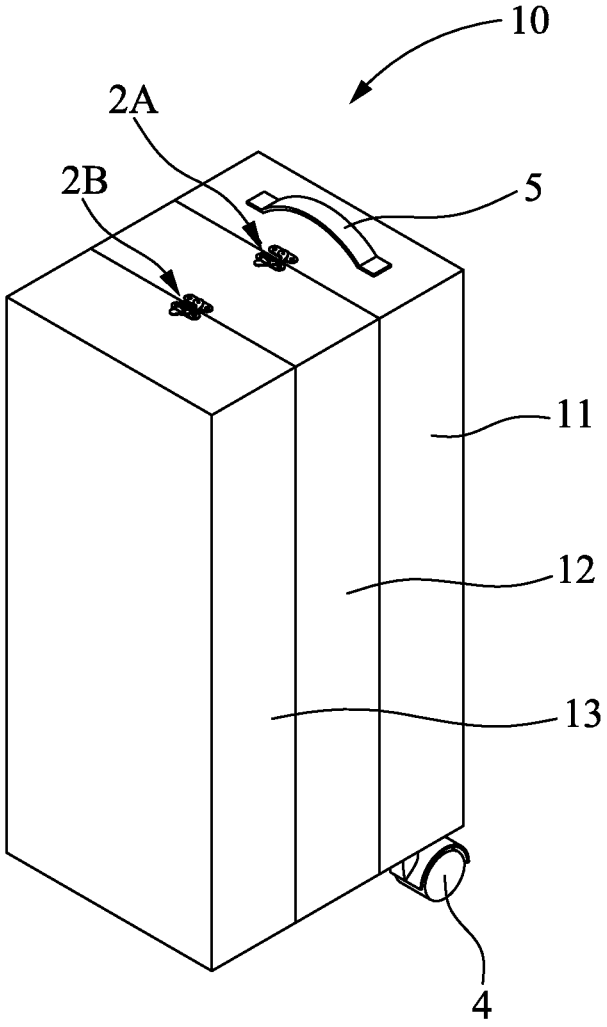
FIG. 6 is a schematic view of the bedhead after folded in accordance with the second embodiment of the present invention.

FIG. 4 to FIG. 6 illustrates a bedhead in accordance with a second embodiment of the present invention. As shown in the drawings, the bedhead 10 of this embodiment includes a first unitary frame 11, a second unitary frame 12 and a third unitary frame 13 which have a same length and are pivotally connected in sequence. An outer side of the first unitary frame 11 is provided with at least one first buckle portion 21. An outer side of the third unitary frame 13 is provided with at least one second buckle portion 23. The second unitary frame 12 is provided with a first locking portion 22 and a second locking portion 24 corresponding to the first buckle portion 21 and the second buckle portion 23. The first buckle portion 21 is mated with the first locking portion 22 to form a first lock 2A. The first lock 2A is used to fasten the first unitary frame 11 and the second unitary frame 12 when folded. The second buckle portion 23 is mated with the second locking portion 24 to form a second lock 2B. The second lock 2B is used to fasten the third unitary frame 13 and the second unitary frame 12 when folded. The bottoms of at least two of the first unitary frame 11, the second unitary frame 12 and the third unitary frame 13 are each provided with at least one detachable leg 3. Furthermore, for inconvenient transportation, at least one of the first unitary frame 11, the second unitary frame 12 and the third unitary frame 13 of the bedhead 10 is provided with wheels 4 at two sides of the bottom thereof and a handle 5 at a top thereof.

When in use, the first unitary frame 11, the second unitary frame 12 and the third unitary frame 13 of the bedhead 10 are turned to unfold. The two legs 3 are mounted at the two sides of the bottom of the bedhead 10. The unitary frames are propped up by the two legs 3, enabling the wheels 4 to be apart from the ground, such that the bedhead 10 stands on the ground steady.

For packing and transportation, the two legs 3 at the bottom of the bedhead 10 are detached from the bedhead 10, enabling the two wheels 4 to be on the ground. The first unitary frame 11 and the third unitary frame 13 are turned toward the front and the back of the second unitary frame 12 to be folded. Through the first lock 2A and the second lock 2B, the first unitary frame 11 and the third unitary frame 13 are folded and fastened at the front and the back of the second unitary frame 12 to form a box, and the width of the box is one-third of the bedhead 10. This reduces the size of the bedhead 10 greatly for packing, transportation and storage. For export transportation, because the volume of the bedhead is reduced greatly, the bedhead can be packed with a standard packing case. The international transportation fee is decreased greatly to lower the cost and to enhance the enterprise revenue. When the bedhead 10 is carried, through the two wheels 4 at the bottom of the bedhead 10 and the handle 5 at the top of the behead 10, the bedhead 10 can be dragged easily and conveniently like a suitcase.

Figure 7:
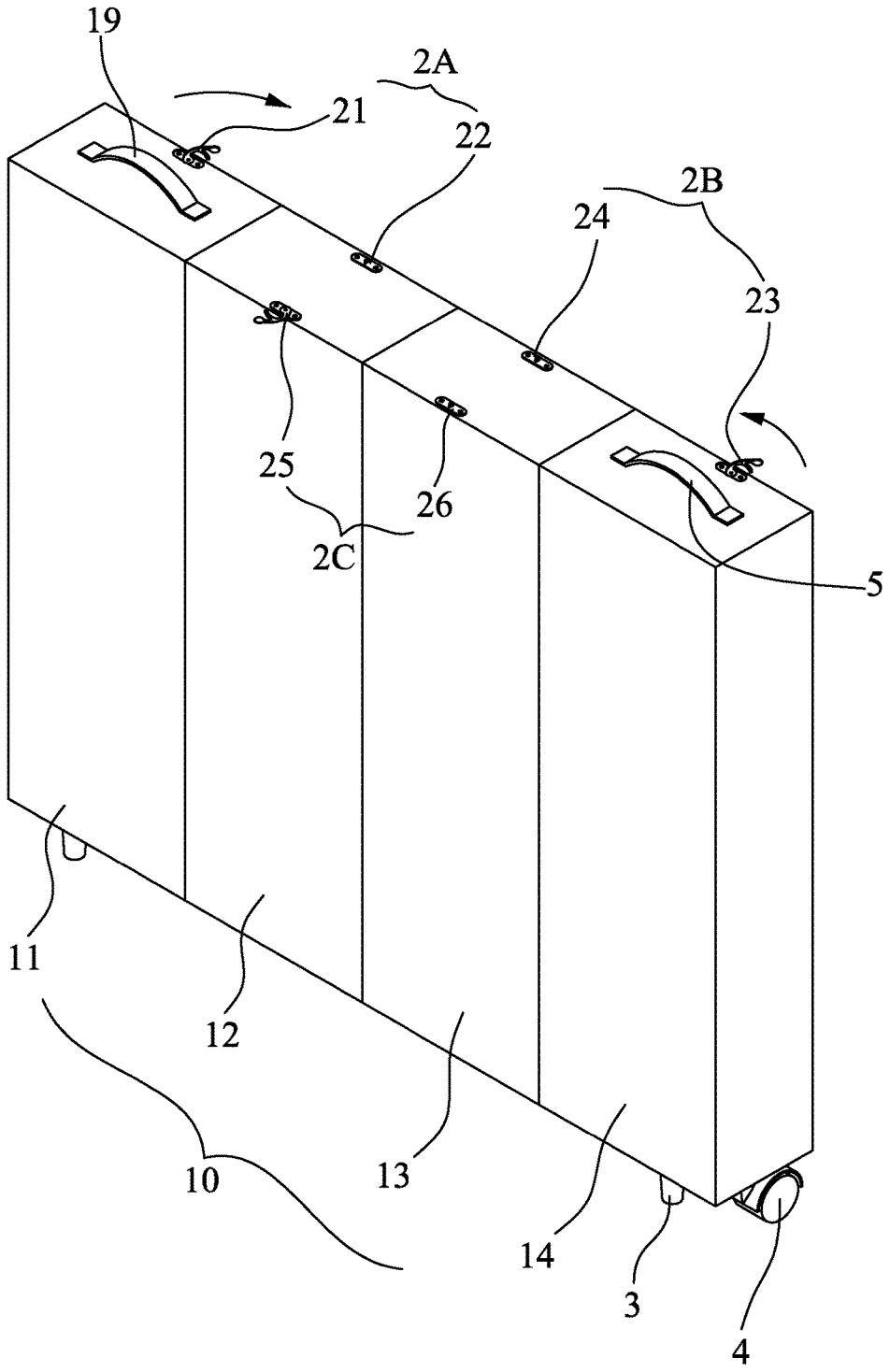
FIG. 7 is a perspective view of the bedhead in accordance with a third embodiment of the present invention.
Figure 8:
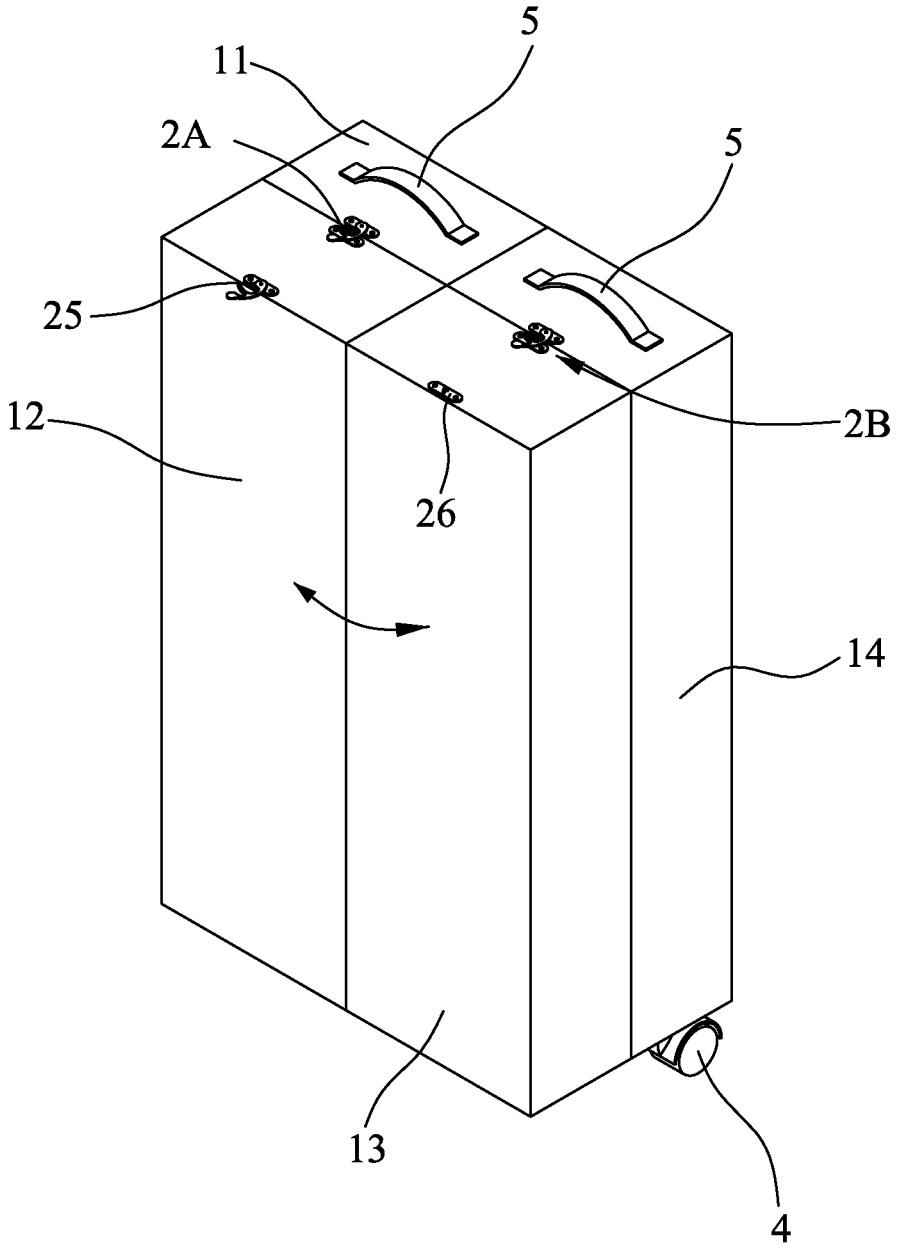
FIG. 8 is a schematic view illustrating the operation of folding the bedhead in accordance with the third embodiment of the present invention.
Figure 9:
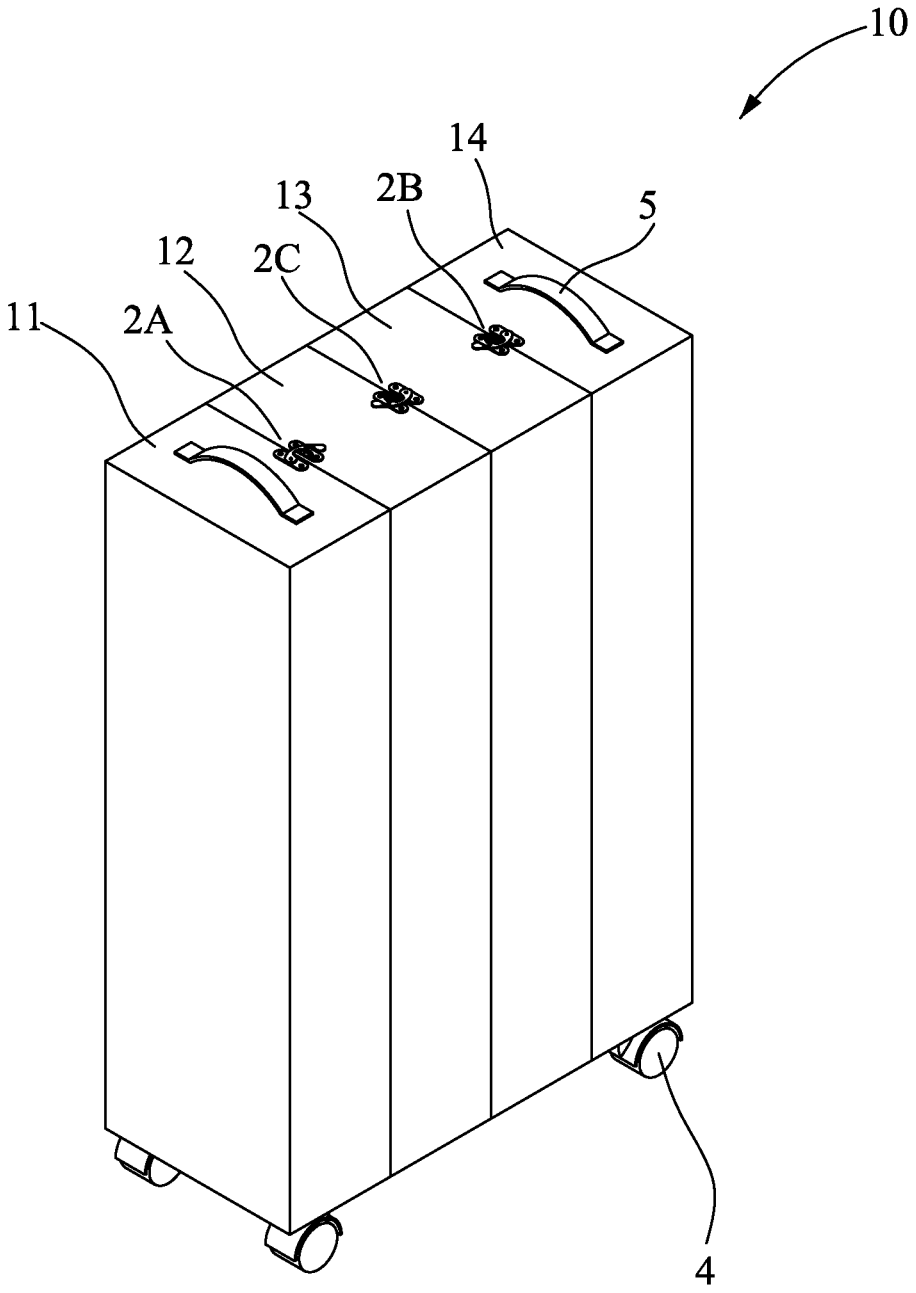
FIG. 9 is a schematic view of the bedhead after folded in accordance with the third embodiment of the present invention.

FIG. 7 to FIG. 9 illustrates a bedhead in accordance with a third embodiment of the present invention. The bedhead 10 of this embodiment includes a first unitary frame 11, a second unitary frame 12, a third unitary frame 13, and a fourth unitary frame 14 which have a same length and are pivotally connected in sequence. In this embodiment, pivotal portions of the first unitary frame 11, the second unitary frame 12, the third unitary frame 13, and the fourth unitary frame 14 are disposed at the sides of every adjacent two of the unitary frames. An outer side of the first unitary frame 11 is provided with at least one first buckle portion 21. The second unitary frame 12 is provided with a first locking portion 22 corresponding to the first buckle portion 21. An outer side of the fourth unitary frame 14 is provided with at least one second buckle portion 23. The third unitary frame 13 is provided with a second locking portion 24 corresponding to the second buckle portion 23. One of the second unitary frame 12 and the third unitary frame 13 is provided with a third buckle portion 25. The other of the second unitary frame 12 and the third unitary frame 13 is provided with a third locking portion 26 corresponding to the third buckle portion 25. The first buckle portion 21 is mated with the first locking portion 22 to form a first lock 2A. The first lock 2A is used to fasten the first unitary frame 11 and the second unitary frame 12 when folded. The second buckle portion 23 is mated with the second locking portion 24 to form a second lock 2B. The second lock 2B is used to fasten the fourth unitary frame 14 and the third unitary frame 13 when folded. The third buckle portion 25 is mated with the third locking portion 26 to form a third lock 2C. The third lock 2C is used to fasten the third unitary frame 12 and the third unitary frame 13 when folded.

The bottoms of at least two of the first unitary frame 11, the second unitary frame 12, the third unitary frame 13, and the fourth unitary frame 14 are each provided with at least one detachable leg 3. Preferably, the bottoms of the first unitary frame 11 and the fourth unitary frame 14 are provided with the legs 3, alternatively, the bottoms of the second unitary frame 12 and the third unitary frame 13 are provided with the legs 3, such that the stress of the bedhead 1 is more even. Furthermore, for inconvenient transportation, at least one of the first unitary frame 11, the second unitary frame 12, the third unitary frame 13, and the fourth unitary frame 14 of the bedhead 10 is provided with wheels 4 at two sides of the bottom thereof and a handle 5 at a top thereof.

When in use, the first unitary frame 11, the second unitary frame 12, the third unitary frame 13, and the fourth unitary frame 14 of the bedhead 10 are turned to unfold. The two legs 3 are mounted at the two sides of the bottom of the bedhead 10. The unitary frames are propped up by the two legs 3, enabling the wheels 4 to be apart from the ground, such that the bedhead 10 stands on the ground steady.

As shown in FIG. 8 and FIG. 9, for packing and transportation, the two legs 3 at the bottom of the bedhead 10 are detached from the bedhead 10, enabling the two wheels 4 to be on the ground. The first unitary frame 11 and the second unitary frame 12 are turned back to back, enabling the back of the first unitary frame 11 to lean against the back of the second unitary frame 12. The first lock 2A is used to fasten the first unitary frame 11 and the second unitary frame 12 when folded. The fourth unitary frame 14 and the third unitary frame 13 are turned back to back, enabling the back of the fourth unitary frame 14 to lean against the back of the third unitary frame 13. The second lock 2B is used to fasten the fourth unitary frame 14 and the third unitary frame 13 when folded. The second unitary frame 12 and the third unitary frame 13 are turned face to face, enabling the front of the second unitary frame 12 to lean against the front of the third unitary frame 13. The third lock 2C is used to fasten the second unitary frame 12 and the third unitary frame 13 when folded. The first unitary frame 11, the second unitary frame 12, the third unitary frame 13, and the fourth unitary frame 14 are folded to form a box and the width of the box is one-fourth of the bedhead 10. This reduces the size of the bedhead 10 greatly for packing, transportation and storage. For export transportation, because the volume of the bedhead is reduced greatly, the bedhead can be packed with a standard packing case. The international transportation fee is decreased greatly to lower the cost and to enhance the enterprise revenue. When the bedhead 10 is carried, through the two wheels 4 at the bottom of the bedhead 10 and the handle 5 at the top of the behead 10, the bedhead 10 can be dragged easily and conveniently like a suitcase.

Figure 10:
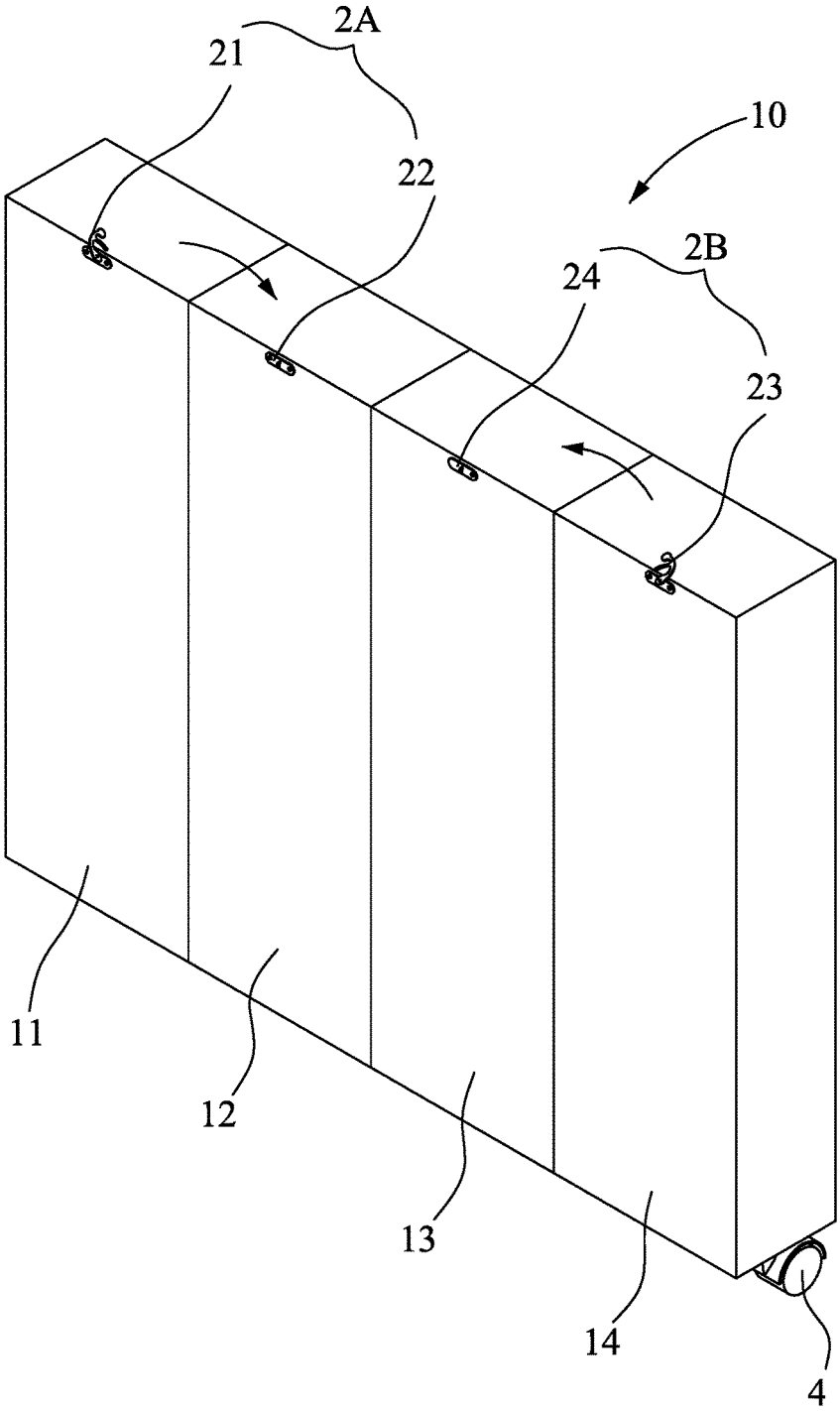
FIG. 10 is a perspective view of the bedhead in accordance with a fourth embodiment of the present invention.
Figure 11:
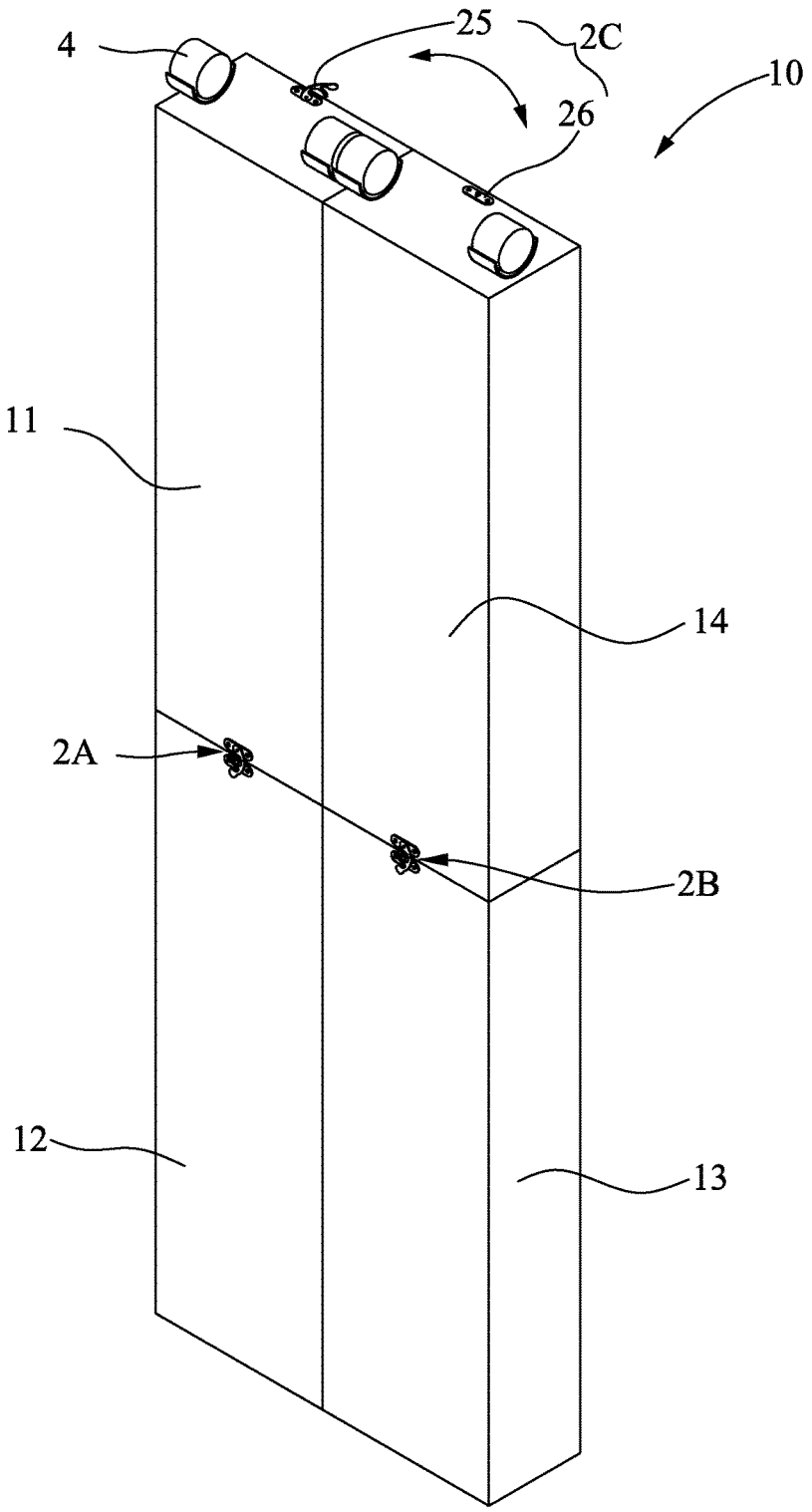
FIG. 11 is a schematic view illustrating the operation of folding the bedhead in accordance with the fourth embodiment of the present invention.
Figure 12:
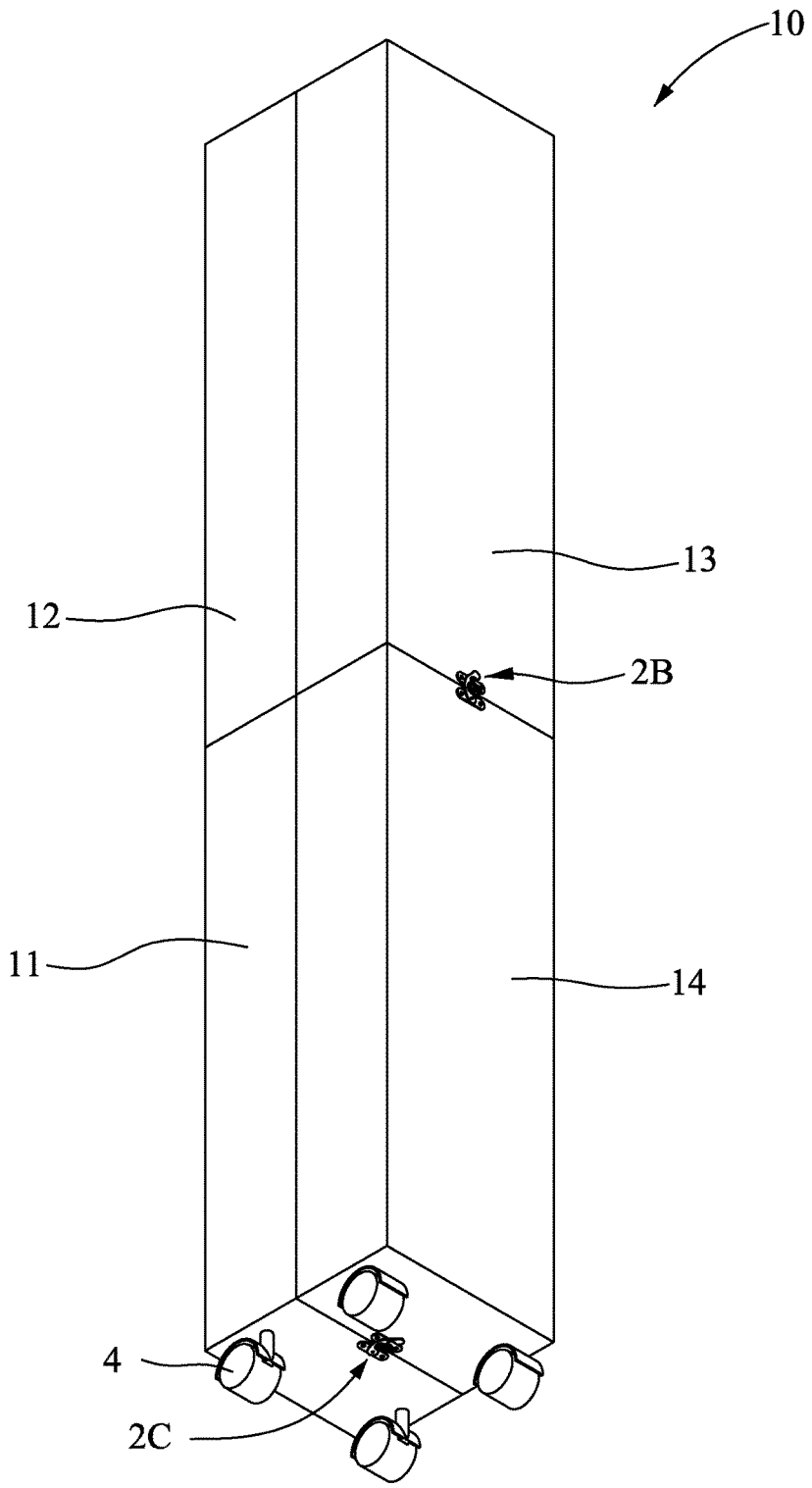
FIG. 12 is a schematic view of the bedhead after folded in accordance with the fourth embodiment of the present invention.

FIG. 10 to FIG. 12 illustrates a bedhead in accordance with a fourth embodiment of the present invention. The fourth embodiment is substantially similar to the third embodiment with the exceptions described hereinafter. Pivotal portions of the first unitary frame 11, the second unitary frame 12, the third unitary frame 13, and the fourth unitary frame 14 are disposed at the tops of every adjacent two of the unitary frames. Because the pivotal positions are different, the folding operation and the folding state of the fourth embodiment are different from the third embodiment. When this embodiment is folded, the first unitary frame 11 is turned toward the top of the second unitary frame 12, enabling the top of the first unitary frame 11 to lean against the top of the second unitary frame 12. The first lock 2A is used to fasten the first unitary frame 11 and the second unitary frame 12 when folded. The fourth unitary frame 14 is turned toward the top of the third unitary frame 13, enabling the top of the fourth unitary frame 14 to lean against the top of the third unitary frame 13. The second lock 2B is used to fasten the third unitary frame 13 and the fourth unitary frame 14 when folded. The second unitary frame 12 and the third unitary frame 13 are turned face to face, enabling the front of the second unitary frame 12 to lean against the front of the third unitary frame 13 to be locked and fastened by the third lock 2C Similarly, the first unitary frame 11, the second unitary frame 12, the third unitary frame 13, and the fourth unitary frame 14 are folded to form a box, and the width of the box is one-fourth of the bedhead 10. After folding, the thickness of the box of the fourth embodiment is less and the length of the box is greater than the box the third embodiment.

The bedhead 10 of this embodiment is composed of four unitary frames which are pivotally connected with one another. Through the first lock 2A, the second lock 2B and the third lock 2C, the unitary frames are fastened when folded. The unitary frames are folded to form a box, and the width of the box is one-fourth of the bedhead 10. This reduces the size of the bedhead 10 greatly for packing, transportation and storage. For export transportation, because the volume of the bedhead is reduced greatly, the bedhead can be packed with a standard packing case. The international transportation fee is decreased greatly to lower the cost and to enhance the enterprise revenue. Besides, the bottom of the bedhead is provided with the two wheels and the top of the bedhead is provided with the handle, so that the bedhead can be dragged easily and conveniently like a suitcase after folded.

FIG. 13 to FIG. 16 illustrates a collapsible bed frame in accordance with a preferred embodiment of the present invention. The collapsible bed frame 20 of the present invention is a slatted bed frame as an example. Other detachable bed frames can be applicable, not limited thereto. The bedhead 10 of the bed frame 20 includes at least two unitary frames. The bedhead 10 can be any one of the aforesaid embodiments. The number of the unitary frames can be different.

As shown in the drawings, the collapsible bed frame 20 of the present invention includes a bedhead 10, two outer support frames 6 at two sides of the front of the bedhead 10, at least one tail frame 7 connected between the two outer support frames 6 opposite the bedhead 10, and an inner support frame 8 disposed between the two outer support frames 6.

In this embodiment, the bedhead 10 includes two unitary frames 10 as an example. The bedhead 10 includes two unitary frames 11, 12. The two unitary frames 11, 12 each have a storage room 111, 121 at the back thereof.

Each outer support frame 6 includes at least two detachable support slabs 61 connected to each other. The connection of the two support slabs 61 can be achieved by hinging, inserting or other connecting ways, which is the existing structure and won't be described hereinafter.

The tail frame 7 includes at least two detachable support slabs 71 connected to each other. The connection of the two support slabs 71 can be achieved by hinging, inserting or other connecting ways, which is the existing structure and won't be described hereinafter.

The inner support frame 8 includes a plurality of support rods 81 to support a bedplate or a mattress. The support rods 81 are detachable.

Figure 13:
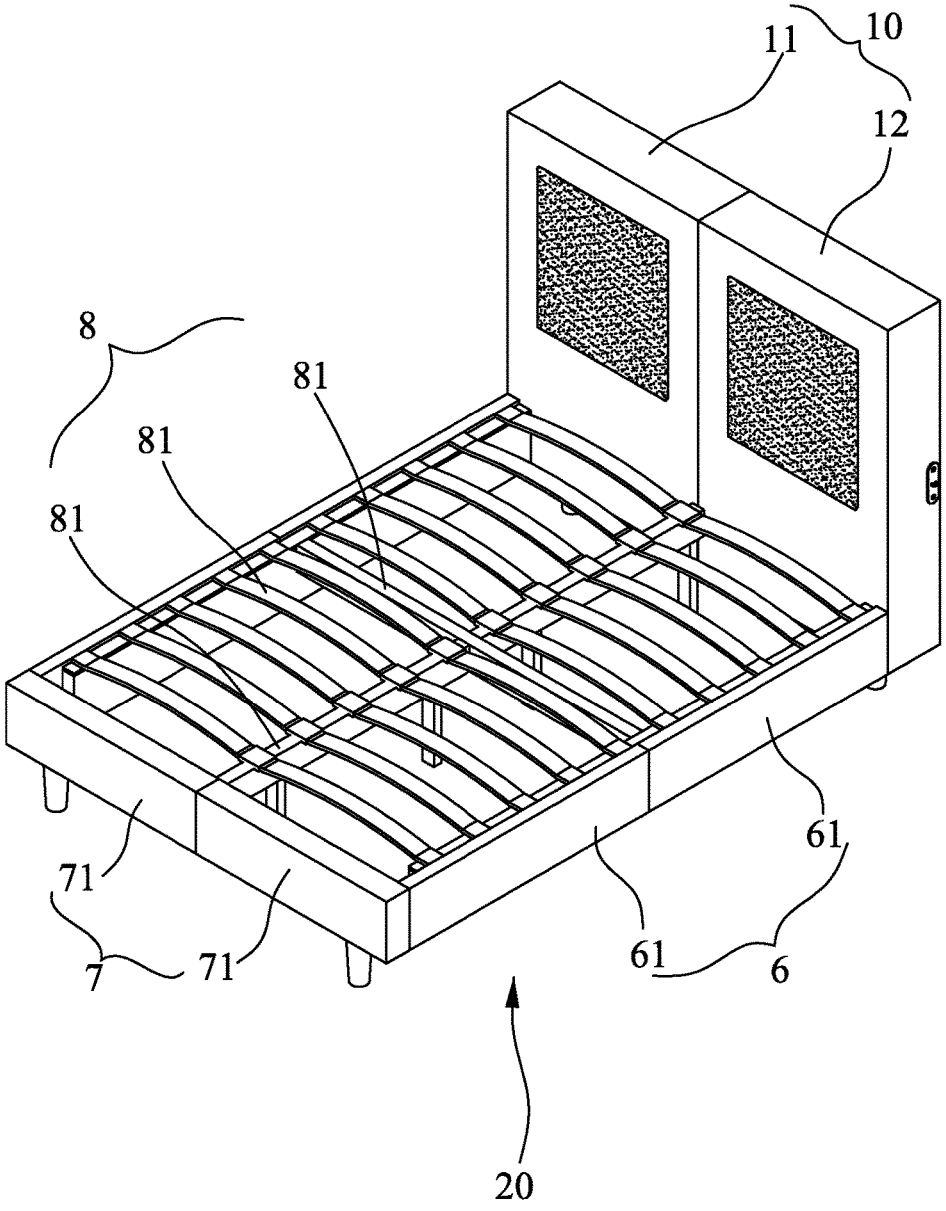
FIG. 13 is a perspective view of the collapsible bed frame of the present invention.
Figure 14:
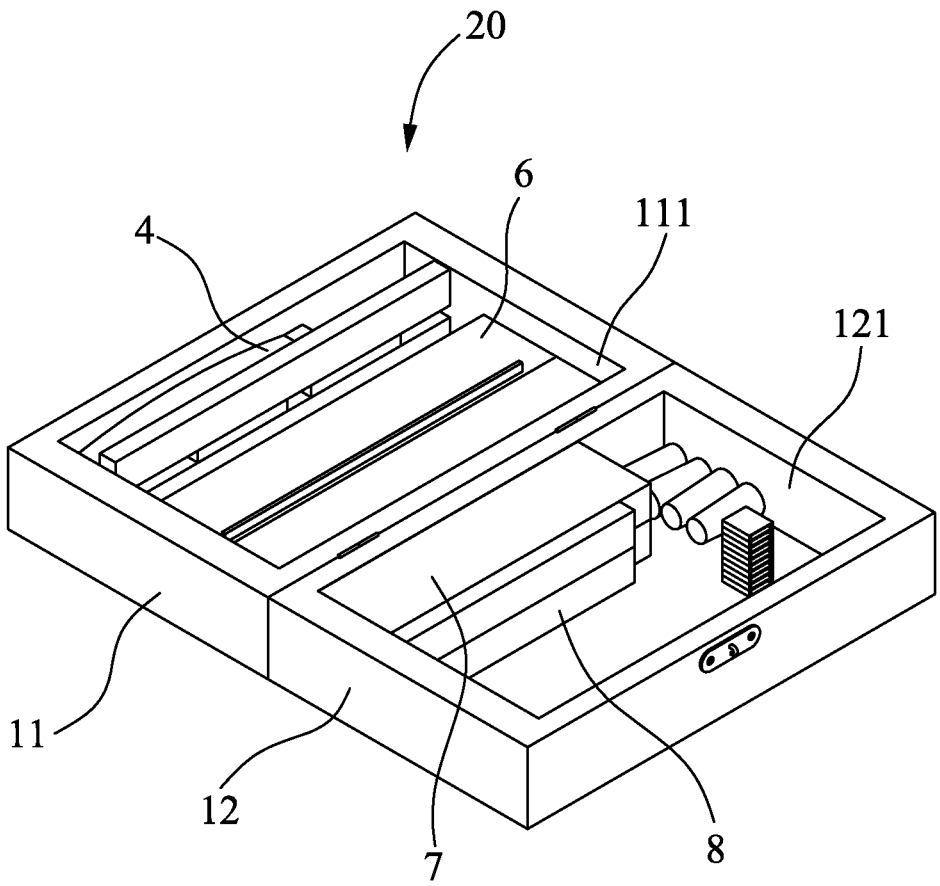
FIG. 14 is a schematic view showing the disassembly and storage of the collapsible bed frame of the present invention.
Figure 15:
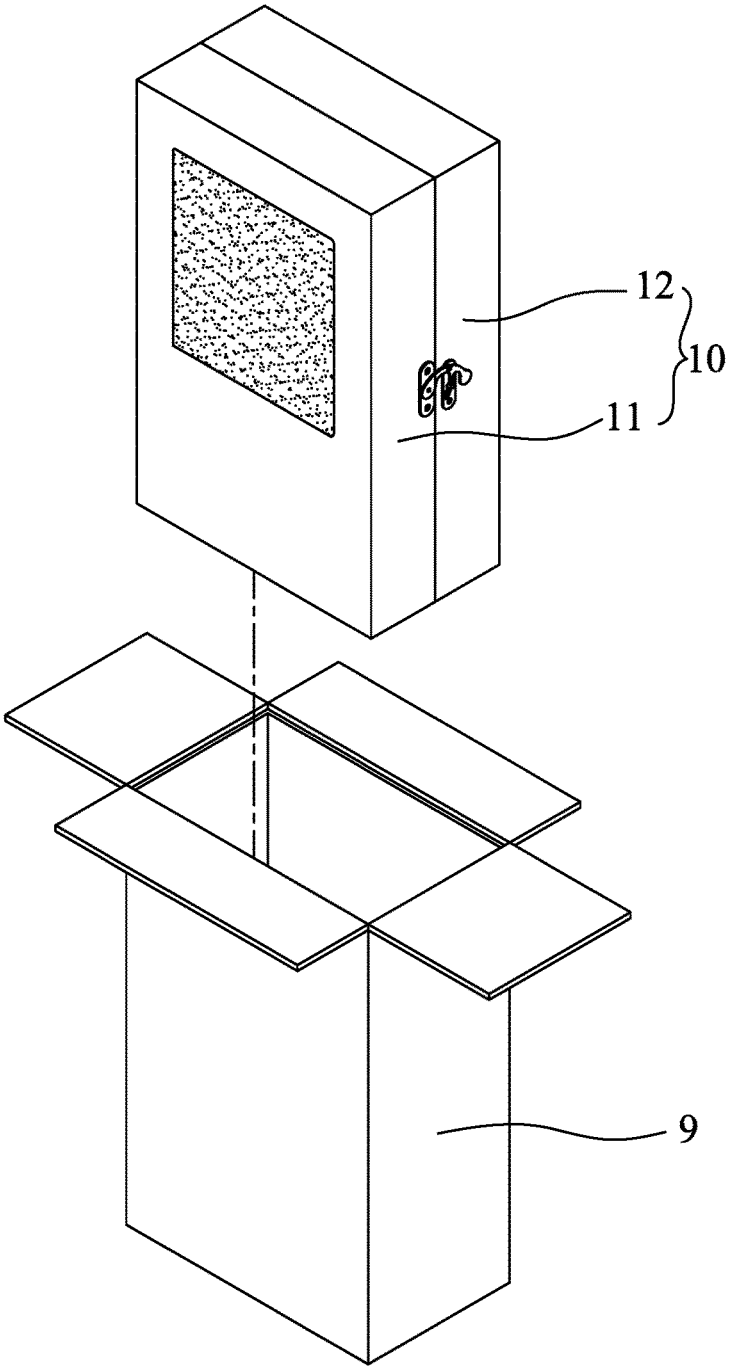
FIG. 15 is a schematic view of the collapsible bed frame after folded of the present invention.
Figure 16:
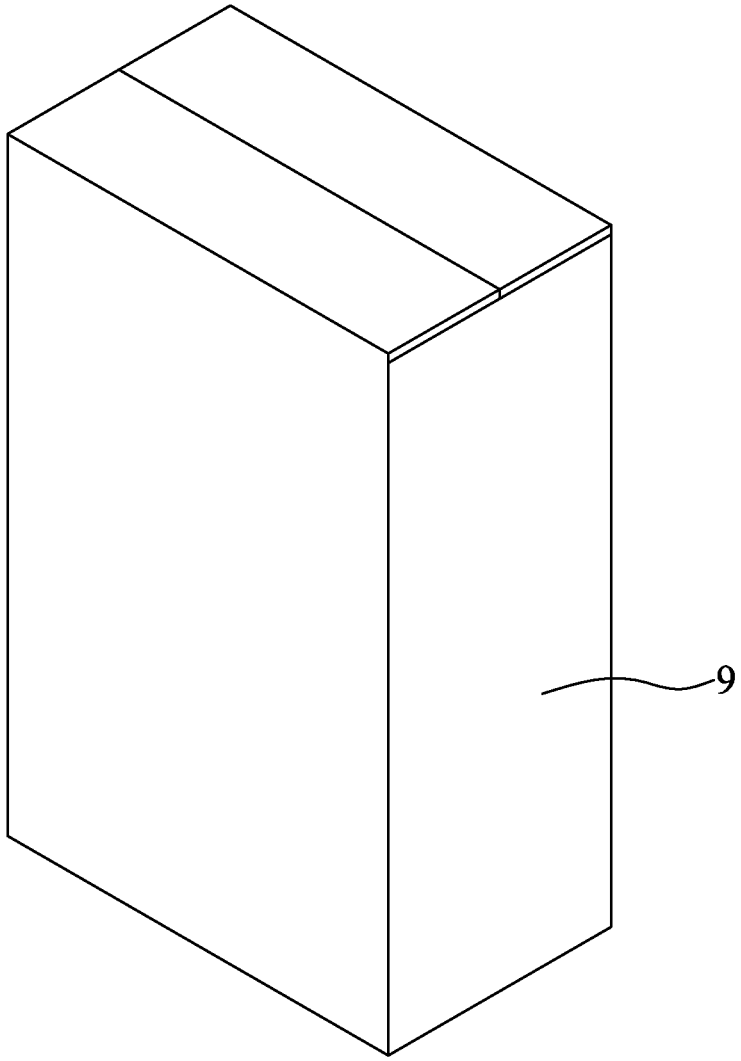
FIG. 16 is a schematic view of the collapsible bed frame placed into the packing case of the present invention.

When assembled, the bedhead 10 uses screws, a locking configuration or other fasteners to secure the corresponding sides of the two unitary frames 11, 12 together. The two unitary frames 11, 12 are arranged side by side. The two ends of the outer support frames 6 are connected with the outer sides of the two unitary frames 11, 12 of the bedhead 10 and two sides of the tail frame 7, respectively. The support rods 81 of the inner support frame 8 are installed in the outer frame. The collapsible bed frame is assembled as shown in FIG. 13.

When disassembled, the support rods of the bed frame 20 are detached and the two unitary frames 11, 12 of the bedhead 10 are also detached. The detached support rods and the related parts are stored in the storage rooms 111, 121 at the backs of the two unitary frames 11, 12. Afterwards, the two unitary frames 11, 12 are turned and mated with each other and buckled by a lock to form a box, and the width of the box is one-half of the bedhead 10. The folded unitary frames 11, 12 are placed into a packing case 9 to prevent the support rods and the related parts from losing. It is convenient for transportation.

The bedhead 10 of the collapsible bed frame of the present invention includes two detachable unitary frames, and the back of the bedhead 10 is provided with storage rooms each having an opening. The support rods and the related parts can be received and stored in the accommodation rooms. The unitary frames can be folded back to back to form a box with a reduced width, such that the size of the bed frame 20 after folded is reduced greatly for packing, transportation and storage. For export transportation, because the volume of the bed frame is reduced greatly, the bed frame can be packed with a standard packing case. The international transportation fee is decreased greatly to lower the cost.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A bedhead, comprising a first unitary frame, a second unitary frame, a third unitary frame, and a fourth unitary frame which have a same length and are pivotally connected in sequence, each unitary frame having at least one storage room at a back thereof, wherein an outer side of the first unitary frame is provided with at least one first buckle portion, the second unitary frame is provided with a first locking portion corresponding to the first buckle portion, an outer side of the fourth unitary frame is provided with at least one second buckle portion, the third unitary frame is provided with a second locking portion corresponding to the second buckle portion, one of the second unitary frame and the third unitary frame is provided with a third buckle portion, the other of the second unitary frame and the third unitary frame is provided with a third locking portion corresponding to the third buckle portion, the first buckle portion is mated with the first locking portion to form a first lock, the second buckle portion is mated with the second locking portion to form a second lock, and the third buckle portion is mated with the third locking portion to form a third lock.

2. The bedhead as claimed in claim 1, wherein pivotal portions of the first unitary frame, the second unitary frame, the third unitary frame, and the fourth unitary frame are disposed at sides of every adjacent two of the unitary frames.

3. A collapsible bed frame with the bedhead as claimed in claim 2, the collapsible bed frame comprising the bedhead, two outer support frames disposed at two sides of the front of the bedhead, at least one tail frame connected between the two outer support frames opposite the bedhead, and an inner support frame disposed between the two outer support frames; the outer support frames and the tail frame each comprising detachable support slabs connected to each other, the inner support frame comprising a plurality of detachable support rods, after disassembled, the outer support frames, the tail frame and the inner support frame being accommodated in the accommodation room at the back of the bedhead.

4. The collapsible bed frame as claimed in claim 3, further comprising a packing case, after the outer support frames, the tail frame and the inner support frame are accommodated in the accommodation room at the back of the bedhead, the collapsible bed frame being placed into the packing case.

5. The bedhead as claimed in claim 1, wherein at least one of the first unitary frame, the second unitary frame, the third unitary frame and the fourth unitary frame is provided with wheels at two sides of a bottom thereof and a handle at a top thereof.

6. The bedhead as claimed in claim 5, further comprising a packing case, the unitary frames after folded being placed into the packing case.

7. The bedhead as claimed in claim 1, wherein pivotal portions of the first unitary frame, the second unitary frame, the third unitary frame, and the fourth unitary frame are disposed at tops of every adjacent two of the unitary frames.

8. A collapsible bed frame with the bedhead as claimed in claim 7, the collapsible bed frame comprising the bedhead, two outer support frames disposed at two sides of the front of the bedhead, at least one tail frame connected between the two outer support frames opposite the bedhead, and an inner support frame disposed between the two outer support frames; the outer support frames and the tail frame each comprising detachable support slabs connected to each other, the inner support frame comprising a plurality of detachable support rods, after disassembled, the outer support frames, the tail frame and the inner support frame being accommodated in the accommodation room at the back of the bedhead.

9. The collapsible bed frame as claimed in claim 8, further comprising a packing case, after the outer support frames, the tail frame and the inner support frame are accommodated in the accommodation room at the back of the bedhead, the collapsible bed frame being placed into the packing case.

10. A collapsible bed frame with the bedhead as claimed in claim 1, the collapsible bed frame comprising the bedhead, two outer support frames disposed at two sides of the front of the bedhead, at least one tail frame connected between the two outer support frames opposite the bedhead, and an inner support frame disposed between the two outer support frames; the outer support frames and the tail frame each comprising detachable support slabs connected to each other, the inner support frame comprising a plurality of detachable support rods, after disassembled, the outer support frames, the tail frame and the inner support frame being accommodated in the accommodation room at the back of the bedhead.

11. The collapsible bed frame as claimed in claim 10, further comprising a packing case, after the outer support frames, the tail frame and the inner support frame are accommodated in the accommodation room at the back of the bedhead, the collapsible bed frame being placed into the packing case.

12. A collapsible bed frame with the bedhead as claimed in claim 1, the collapsible bed frame comprising the bedhead, two outer support frames disposed at two sides of the front of the bedhead, at least one tail frame connected between the two outer support frames opposite the bedhead, and an inner support frame disposed between the two outer support frames; the outer support frames and the tail frame each comprising detachable support slabs connected to each other, the inner support frame comprising a plurality of detachable support rods, after disassembled, the outer support frames, the tail frame and the inner support frame being accommodated in the accommodation room at the back of the bedhead.

13. The collapsible bed frame as claimed in claim 12, further comprising a packing case, after the outer support frames, the tail frame and the inner support frame are accommodated in the accommodation room at the back of the bedhead, the collapsible bed frame being placed into the packing case.

* * * * *